US011072919B1

(12) United States Patent
Xiao et al.

(10) Patent No.: US 11,072,919 B1
(45) Date of Patent: Jul. 27, 2021

(54) AUTOMATIC FLUSHING SQUATTING TOILET

(71) Applicant: NOZO GROUP CO., LTD., Shenzhen (CN)

(72) Inventors: Ke Xiao, Shenzhen (CN); Xue Li, Shenzhen (CN)

(73) Assignee: NOZO GROUP CO., LTD., Shenzhen (CN)

( * ) Notice: Subject to any disclaimer, the term of this patent is extended or adjusted under 35 U.S.C. 154(b) by 0 days.

(21) Appl. No.: 17/124,526

(22) Filed: Dec. 17, 2020

(30) Foreign Application Priority Data

Jan. 6, 2020 (CN) ..... 202010007981.8

(51) Int. Cl.
*E03D 9/03* (2006.01)
*E03D 5/10* (2006.01)
*E03D 5/08* (2006.01)

(52) U.S. Cl.
CPC ..... *E03D 9/037* (2013.01); *E03D 5/08* (2013.01); *E03D 5/10* (2013.01)

(58) Field of Classification Search
CPC ..... E03D 11/04; E03D 11/13; E03D 5/028; E03D 5/04; E03D 5/08; E03D 5/10–105; E03D 9/035; E03D 9/037
See application file for complete search history.

(56) References Cited

U.S. PATENT DOCUMENTS 1,243,148 A * 10/1917 Erwin ..... A47K 17/02 4/300
2004/0262552 A1 12/2004 Lowe
2020/0149260 A1* 5/2020 Pamula ..... H02S 10/20

FOREIGN PATENT DOCUMENTS

| | | | |
|---|---|---|---|
| CN | 202831143 | U | 3/2013 |
| CN | 203834611 | U | 9/2014 |
| CN | 204185920 | U | 3/2015 |
| CN | 205134467 | U | 4/2016 |
| CN | 205667537 | U | 11/2016 |
| CN | 109356254 | A | 2/2019 |
| DE | 4306847 | A1 | 9/1994 |
| DE | 19753947 | A1 | 6/1999 |
| FR | 2602566 | A1 | 2/1988 |

* cited by examiner

*Primary Examiner* — David P Angwin
*Assistant Examiner* — Nicholas A Ros

(57) ABSTRACT

An automatic flushing squatting toilet includes a toilet body and a water tank. Flushing mechanisms are disposed inside the toilet body. The flushing mechanisms include installing grooves disposed on an upper wall of the toilet body. An inner wall of each installing groove close to an upper end of each installing groove is fixedly connected with a respective flexible plate. Each installing groove is fixedly connected with a respective piezoelectric plate. A lower wall of each flexible plate is fixedly connected with a respective pressing block. Each pressing block contacts a corresponding piezoelectric plate. Water sucking cavities are disposed inside the toilet body. Each water sucking cavity is fixedly connected with a metal plate. Each water sucking cavity is elastically connected with a respective electromagnetic plate through a respective return spring. Each electromagnetic plate is slidably connected with each water sucking cavity.

1 Claim, 2 Drawing Sheets

AUTOMATIC FLUSHING SQUATTING TOILET

TECHNICAL FIELD

The present disclosure relates to a field of sanitary appliances technology, and in particular to an automatic flushing squatting toilet that is able to automatically dispense a fixed amount of detergent.

BACKGROUND squatting toilets are installed in restrooms of some public places such as stations, shopping malls, or office buildings. Since the squatting toilets occupy almost no space above the ground, and are cheaper than pedestal pans, the squatting toilets are more popular in these public places. However, the conventional squatting toilets have following problems:

1. When using a conventional squatting toilet, people generally need to press a button on a water tank or step on a valve that controls the water flow to flush the water after use. In these public places, some people do not pay enough attention to hygiene, so it often happens that someone does press the button after using the squatting toilet, which has a bad impact on the environment of public places and also affects people who use the squatting toilet next.

2. In order to make the flushing effect better, detergent is used. Generally, the detergent is directly poured into the water tank at one time and mixed with the water in the water tank. However, during use, only in first few flushes, cleaning effect of the squatting toilet is good. As the number of flushes increases, the water in the water tank is continuously consumed and refilled, which greatly reduces the content of the detergent and directly affect the performance of the detergent.

SUMMARY

In order to solve problem in the prior art, the present disclosure provides an automatic flushing squatting toilet that is able to automatically dispense a fixed amount of detergent.

In order to achieve the above objectives, the present disclosure adopts following technical solutions.

The present disclosure provides an automatic flushing squatting toilet that is able to automatically dispense a fixed amount of detergent. The automatic flushing squatting toilet comprises a toilet body and a water tank. Flushing mechanisms are disposed inside the toilet body. Each flushing mechanism comprises an installing groove disposed on an upper wall of the toilet body. An inner wall of each installing groove close to an upper end of each installing groove is fixedly connected with a respective flexible plate. An inner bottom portion of each installing groove is fixedly connected with a respective piezoelectric plate. A lower wall of each flexible plate is fixedly connected with a respective pressing block. Each pressing block contacts a corresponding piezoelectric plate. Water sucking cavities are disposed inside the toilet body. An inner wall of each water sucking cavity is fixedly connected with a metal plate. The inner wall of each water sucking cavity is elastically connected with a respective electromagnetic plate through a respective return spring. Each electromagnetic plate is slidably connected with the inner wall of each water sucking cavity, there is no gap between each electromagnetic plate and the inner wall of each water sucking cavity. Each electromagnetic plate is electrically connected with a corresponding piezoelectric plate. One end of each water sucking cavity close to a corresponding electromagnetic plate is communicated with the water tank through a respective water inlet pipe. A first one-way valve is disposed on one end of each water inlet pipe close to the water sucking cavities. A lower wall of each water sucking cavity is communicated with a respective water outlet pipe. A pressure valve is disposed on one end of each water outlet pipe close to the water sucking cavities. Dispensing mechanisms are disposed inside the toilet body.

Optionally, each dispensing mechanism comprises a liquid storage cavity. Control cavities is disposed inside the toilet body. An inner wall of each control cavity is rotatably connected with a respective control disk through a respective rotating shaft. A side wall of each control disk is slidably connected with an inner wall of a corresponding control cavity. There is no gap between the side wall of each control disk and an inner wall of the corresponding control cavity. A lower wall of each liquid storage cavity is communicated with an upper wall of a corresponding control cavity through a respective liquid inlet pipe. A side wall of each control cavity is communicated with a side wall of the corresponding water sucking cavity through a respective liquid outlet pipe. A second one-way valve is disposed on one end of each liquid outlet pipe close to the water sucking cavities. A liquid accommodating groove and a control groove are disposed in a side wall of each control disk. Each liquid accommodating groove is communicated with a corresponding liquid inlet pipe. The inner wall of each control cavity is fixedly connected with a respective baffle. Each baffle is disposed in a corresponding control groove. A metal block is fixedly embedded in one end of each control groove away from a corresponding baffle. A side wall of each metal block is elastically connected with a side wall of the corresponding baffle opposite to the side wall of each metal block through a respective compression spring.

Compared with the prior art, the present disclosure comprises the flushing mechanisms. When a user steps on the flexible plates, the pressing blocks move downward to press the piezoelectric plates, so that the electromagnetic plates are energized to generate magnetism, and are attracted by the metal plates to move to the left. Meanwhile, the water in the water tank flows into the water sucking cavities. When the user leaves, the flexible plates return to their original shape, the piezoelectric plates no longer generate current, and the magnetism of the electromagnetic plates disappears. Then, the electromagnetic plates are pulled to the right by the return springs and the water in the water sucking cavities is discharged from the water outlet pipes. The toilet body is flushed by the discharged water and there is no need for people to manually control the flushing and cleaning of the squatting toilet. The present disclosure is convenient to use, prevents people from not flushing the squatting toilet, and ensures the environment in the restrooms of public places.

Compared with the prior art, the present disclosure comprises the dispensing mechanisms. When the electromagnetic plates move to a left side of the metal blocks, the electromagnetic plates attract the metal blocks to move, and then drive the control disks to rotate to pour detergent in the liquid accommodating grooves into the water sucking cavities through the liquid outlet pipes. The detergent is mixed with the water in the water sucking cavities and then the mixture is discharged to flush the toilet body, which makes a flushing effect good. After the magnetism of the electromagnetic plates disappear, the metal blocks drive the control disks to rotate in an opposite direction under elastic force of the compression springs, and the detergent in the liquid storage cavities flows into the liquid accommodating grooves again for a next flush. In general, the present disclosure is able to automatically dispense a certain amount of detergent during each flush, avoiding a waste of detergent and also enabling the cleaning effect of the detergent.

Figure 1:
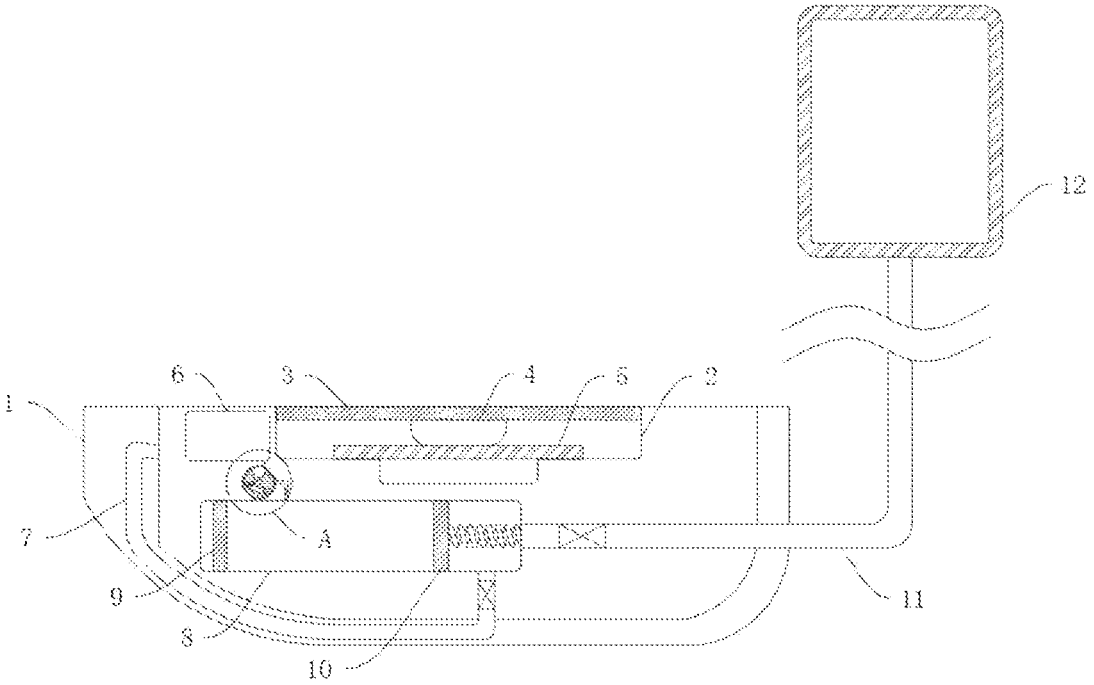
FIG. 1 is a schematic diagram showing a structure of an automatic flushing squatting toilet that is able to automatically dispense a fixed amount of detergent of the present disclosure.

1—toilet body; 2—installing groove; 3—flexible plate; 4—pressing block; 5—piezoelectric plate; 6—liquid storage cavity; 7—water outlet pipe; 8—water sucking cavity; 9—metal plate; 10—electromagnetic plate; 11—water inlet pipe; 12—water tank; 13—liquid accommodating groove; 14—metal block; 15—liquid inlet pipe; 16—liquid outlet pipe; 17—control cavity; 18—control disk; 19—control groove; 20—baffle; and 21—rotating shaft.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all the embodiments.

In the description of the present disclosure, it should be understood that orientation or positional relationship indicated by terms "upper", "lower", "front", "rear", "left", "right", "top", "bottom", "inner", "outside" is based on the orientation or positional relationship shown in the drawings. It is only for the convenience of describing the present disclosure and simplifying the description, and does not indicate or imply that the device or element referred to must have a specific orientation or must have specific azimuth structure and operation, which should not be understood as limitations of the present disclosure.

Figure 2:
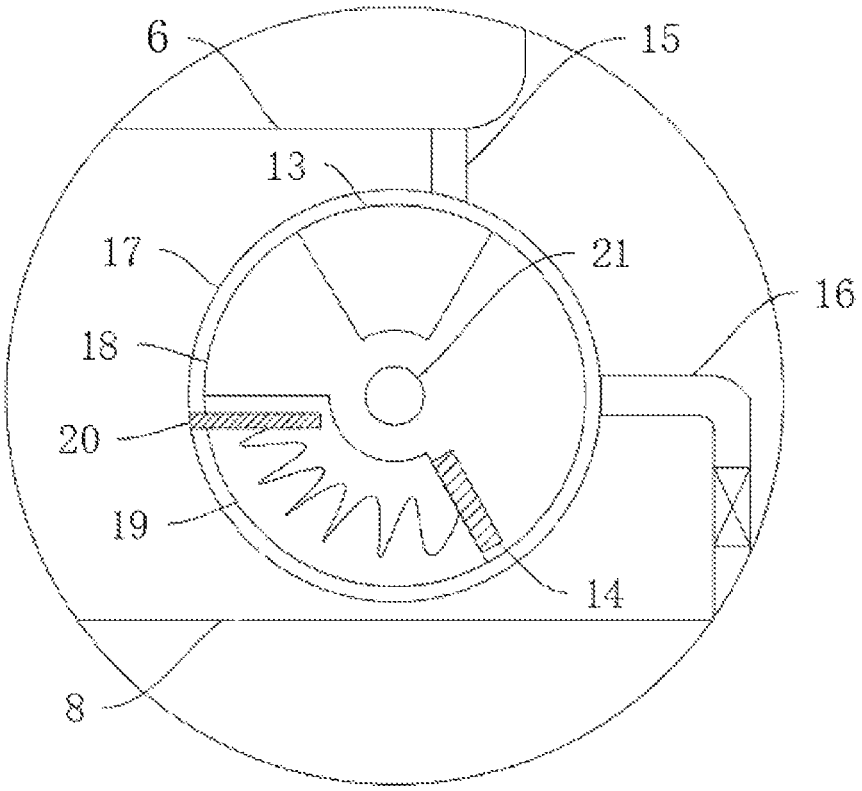
FIG. 2 is an enlarged view of area A of the automatic flushing squatting toilet that is able to automatically dispense the fixed amount of detergent of the present disclosure.

As shown in FIGS. 1 and 2, the present disclosure provides an automatic flushing squatting toilet that is able to automatically dispense a fixed amount of detergent. The automatic flushing squatting toilet comprises a toilet body 1 and a water tank 12. Flushing mechanisms are disposed in the toilet body 1. It is noted that each squatting toilet comprises two flushing mechanisms, which are symmetrical disposed in both sides of the toilet body 1 corresponding to foot areas that a user steps on. Simultaneous use of the two flushing mechanisms increases an amount of flushing water and a cleaning effect of the automatic flushing squatting toilet.

Each flushing mechanism comprises an installing groove 2 disposed on an upper wall of the toilet body 1. An inner wall of each installing groove 2 close to an upper end of each installing groove 2 is fixedly connected with a respective flexible plate 3. An inner bottom portion of each installing groove 2 is fixedly connected with a respective piezoelectric plate 5. The piezoelectric plates 5 are made of piezoelectric material. The piezoelectric material is a crystal material that generates current when subjected to pressure. It is noted that each installing groove 2 is a T-shaped groove, and a lower wall of each piezoelectric plate 5 close to a middle portion of each piezoelectric plate 5 does not touch an inner bottom of a corresponding installing groove 2, A lower wall of each flexible plate 3 is fixedly connected with a respective pressing block 4. Each pressing block 4 contacts a corresponding piezoelectric plate 5. A lower wall of each pressing block 4 is a curved surface, which reduces a contact area with the corresponding piezoelectric plate 5, so that pressure on the piezoelectric plates 5 is more concentrated, making it easy to generate current and not easy to damage the piezoelectric plates 5.

Water sucking cavities 8 is disposed in the toilet body 1. A metal plate 9 is fixedly connected with an inner wall of each water sucking cavity 8. An electromagnetic plate 10 is elastically connected with the inner wall of the water sucking cavity 8 through a respective return spring. Each electromagnetic plate 10 is slidably connected with the inner wall of a corresponding water sucking cavity 8. There is no gap between each electromagnetic plate 10 and the inner wall of the corresponding water sucking cavity 8. Each electromagnetic plate 10 is electrically connected with a corresponding piezoelectric plate 5. One end of each water sucking cavity 8 close to a corresponding electromagnetic plate 10 is communicated with the water tank 12 through a respective water inlet pipe 11. A first one-way valve is disposed on one end of each water inlet pipe 11 close to the water sucking cavities 8. The first one-way valves prevent the water in the water sucking cavities 8 from flowing back into the water tank 12, Each water outlet pipe 7 is communicated with a lower wall of a corresponding water sucking cavity 8. A pressure valve is disposed on one end of each water outlet pipe 7 close to the water sucking cavities 8. The pressure valves open only when pressure reaches a predetermined critical value, and then all the water in the water sucking cavities 8 is erupt out. It is noted that ends of the two water outlet pipes 7 of the two flushing mechanisms away from the water sucking cavities 8 are communicated with each other, and extend to a left side area of the toilet body 1 close to a middle area of the toilet body 8.

Dispensing mechanisms are disposed in the toilet body 1. Each dispensing mechanism comprises a liquid storage cavity 6. Each liquid storage cavity 6 is filled with detergent. Furthermore, a feed pipe or a feed port may be provided on a side wall of each liquid storage cavity 6 to facilitate supplementation of the detergent after the detergent is used up. Control cavities 17 are disposed in the toilet body 1. A cross section of each control cavity 17 is circular. An inner wall of each control cavity 17 is rotatably connected with a respective control disk 18 through a respective rotating shaft 21. A side wall of each control disk 18 is slidably connected with an inner wall of a corresponding control cavity 17. There is no gap between the side wall of each control disk 18 and the inner wall of the corresponding control cavity 17. A lower wall of each liquid storage cavity 6 is communicated with an upper wall of a corresponding control cavity 17 through a respective liquid inlet pipe 15. A side wall of each control cavity 17 is communicated with a side wall of a corresponding water sucking cavity 8 through a respective liquid outlet pipe 16. A second one-way valve is disposed on one end of each liquid outlet pipe 16 close to the water sucking cavities 8. The second one-way valves prevent water in the water sucking cavities 8 from entering the control cavities 17, A liquid accommodating groove 13 and a control groove 19 are disposed in a side wall of each control disk 18. Each liquid accommodating groove 13 is communicated with a respective liquid inlet pipe 15. The inner wall of each control cavity 17 is fixedly connected with a respective baffle 20.

Each baffle 20 is disposed in a corresponding control groove 19. A metal block 14 is fixedly embedded in one end of each control groove 19 away from a corresponding baffle 20. A side wall of each metal block 14 is elastically connected with a side wall of the corresponding baffle 20 opposite to the side wall of the metal block 14 through a respective compression spring.

When in use, a user steps on the flexible plates 3, the flexible plates 3 are pressed to dent downward, so that the pressing blocks 4 moves downward to press the piezoelectric plates. The electromagnetic plates 10 are energized to generate magnetism, and are attracted by the metal plates 9 to move to the left. Meanwhile, the water in the water tank 12 is sucked into the water sucking cavities 8. It is noted that, at this time, pulling force of the return springs on the electromagnetic plates 10 are offset by attractive force of the metal plates 9 on the electromagnetic plates 10 (the attractive force is greater than the pulling force of the return springs, and resultant force of the external force on the electromagnetic plates 10 is to the left). The pressure valves are closed at this time, and the water is stored in the water sucking cavities 8.

When the user finish using the restroom and leaves the automatic flushing squatting toilet, the flexible plates 3 return to their original shapes, the pressing blocks 4 no longer press the piezoelectric plates 5. The magnetism of the electromagnetic plates 10 disappear and the metal plates no longer attract the electromagnetic plates 10. Then, the electromagnetic plates 10 are pulled to the right by the return springs and the water in the water sucking cavities 8 is erupt from the water outlet pipes 7 to flush feces on the toilet body 1.

When the electromagnetic plates 10 move to positions close to right sides of the control disks 18, the metal blocks 14 tend to move to the right due to attraction force of the electromagnetic plates 10 to the right. However, the control disks 18 are unable to rotate counterclockwise, when the electromagnetic plates 10 move to positions close to left sides of the control disks 18, they attract the metal blocks 14 to move to the left and press the compression springs. The metal blocks 14 drive the control disks 18 to rotate clockwise, so that the liquid accommodating grooves 13 are rotated to positions facing the liquid outlet pipes 16. The detergent in the liquid accommodating grooves 13 flows into the water sucking cavities 8 through the liquid outlet pipes 16, and is mixed with the water in the water sucking cavities 8 to flush the feces, which makes the cleaning effect good.

When the magnetism of the electromagnetic plates 10 disappears, the metal blocks 14 are no longer under the attraction force of the electromagnetic plates 10. Under the elastic force of the compression springs, the metal blocks 14 moves to the right and drive the control disks 18 to rotate counterclockwise, so that the liquid accommodating grooves 13 rotate to face the liquid inlet pipes. At this time, the detergent in the liquid storage cavities 6 flows into the liquid accommodating grooves 13 through the liquid inlet pipes 15 to prepare for the next flush.

It is noted that in the embodiment, the metal plates and the metal blocks may be made of iron, stainless steel, or other metal materials, which is not limited thereto.

The above are only optional specific embodiments of the present disclosure but the protection scope of the present disclosure is not limited thereto. Within the technical scope disclosed by the present disclosure, equivalent replacements or changes made by those skilled in the art according to technical solutions or inventive concepts of the present disclosure should all fall within the protection scope of the present disclosure.

What is claimed is:

1. An automatic flushing squatting toilet, comprising:

a toilet body (1) and a water tank (12);

wherein flushing mechanisms are disposed inside the toilet body (1); each flushing mechanism comprises an installing groove (2) disposed on an upper wall of the toilet body (2); an inner wall of each installing groove (2) close to an upper end of each installing groove (2) is fixedly connected with a respective flexible plate (3); an inner bottom portion of each installing groove (2) is fixedly connected with a respective piezoelectric plate (5); a lower wall of each flexible plate (3) is fixedly connected with a respective pressing block (4); each pressing block contacts a corresponding piezoelectric plate (5); water sucking cavities (8) are disposed inside the toilet body (1); an inner wall of each water sucking cavity (8)) is fixedly connected with a metal plate (9); the inner wall of each water sucking cavity (8) is elastically connected with a respective electromagnetic plate (10) through a respective return spring; each electromagnetic plate (10) is slidably connected with the inner wall of each water sucking cavity (8), there is no gap between circumferential edges of each electromagnetic plate (10) and the inner wall of each water sucking cavity (8); each electromagnetic plate (10) is electrically connected with a corresponding piezoelectric plate (5), one end of each water sucking cavity (8) close to a corresponding electromagnetic plate (10) is communicated with the water tank (12) through a respective water inlet pipe (11); a first one-way valve is disposed on one end of each water inlet pipe (11) close to the water sucking cavities (8); a lower wall of each water sucking cavity (8) is communicated with a respective water outlet pipe (7); a pressure valve is disposed on one end of each water outlet pipe (7) close to the water sucking cavities (8); and dispensing mechanisms are disposed inside the toilet body (1);

wherein each dispensing mechanism comprises a liquid storage cavity (6); control cavities (17) are disposed inside the toilet body (1); an inner wall of each control cavity (17) is rotatably connected with a respective control disk (18) through a respective rotating shaft (21); a side wall of each control disk (18) is slidably connected with an inner wall of a corresponding control cavity (17); there is no gap between an outermost edge of each control disk (18) and an inner wall of the corresponding control cavity (17); a lower wall of each liquid storage cavity (6) is communicated with an upper wall of a corresponding control cavity (17) through a respective liquid inlet pipe (15), a side wall of each control cavity (17) is communicated with a side wall of a corresponding water sucking cavity (8) through a respective liquid outlet pipe (16); a second one-way valve is disposed on one end of each liquid outlet pipe (16) close to the water sucking cavities (8); a liquid accommodating groove (13) and a control groove (19) are disposed in a side wall of each control disk (18); each liquid accommodating groove (13) is communicated with a corresponding liquid inlet pipe (15); the inner wall of each control cavity (17) is fixedly connected with a respective baffle (20); each baffle (20) is disposed in a corresponding control groove (19); a metal block (14) is fixedly embedded in one end of each control groove (19) away from a corresponding baffle (20); a side wall of each metal block (14) is elastically connected with a side wall of the corresponding baffle (20) opposite to the side wall of each metal block (14) through a respective compression spring.

* * * * *